US006786938B1

(12) United States Patent
Cemenska et al.

(10) Patent No.: US 6,786,938 B1
(45) Date of Patent: Sep. 7, 2004

(54) AQUEOUS FUEL FORMULATION FOR REDUCED DEPOSIT FORMATION ON ENGINE SYSTEM COMPONENTS

(75) Inventors: Richard A. Cemenska, Edelstein, IL (US); Gerald N. Coleman, Peoria, IL (US)

(73) Assignee: Clean Fuel Technology, Inc., Reno, NV (US)

( * ) Notice: Subject to any disclaimer, the term of this patent is extended or adjusted under 35 U.S.C. 154(b) by 7 days.

(21) Appl. No.: 09/649,648

(22) Filed: Aug. 29, 2000

Related U.S. Application Data

(63) Continuation of application No. 09/208,652, filed on Dec. 10, 1998.
(60) Provisional application No. 60/069,385, filed on Dec. 12, 1997.

(51) Int. Cl.[7] ..... C10L 1/32
(52) U.S. Cl. ..... 44/301; 44/302
(58) Field of Search ..... 44/301, 302

(56) References Cited

U.S. PATENT DOCUMENTS 3,490,237 A 1/1970 Lissant ..... 60/217
3,527,581 A * 9/1970 Brownawell ..... 44/301
5,284,492 A * 2/1994 Dubin ..... 44/301
5,372,613 A 12/1994 Mekonen ..... 44/301
5,669,938 A * 9/1997 Schwab ..... 44/301
5,873,916 A * 2/1999 Cemenska et al. ..... 44/301

FOREIGN PATENT DOCUMENTS

EP 0 310 766 A1 2/1989 ..... B01F/3/08
GB 2071140 A * 9/1981

OTHER PUBLICATIONS http://www.nsf.org/consumer/consumer_bw.html (2002).*

* cited by examiner

*Primary Examiner*—Cephia D. Toomer
(74) *Attorney, Agent, or Firm*—Sierra Patent Group, Ltd.

(57) ABSTRACT

An aqueous fuel composition comprising hydrocarbon petroleum distillate, purified water, and an additive composition, in which the aqueous fuel composition, and particularly the additive composition, is comprised of components which are essentially free of silicon, resulting in a fuel having reduced particulate emissions with a resulting reduction in exhaust system deposits. The disclosure further provides for an aqueous fuel composition adapted for use in an internal combustion engine having selected components of the fuel system coated with a metal nitride coating, such as chromium nitride or titanium nitride.

1 Claim, No Drawings

AQUEOUS FUEL FORMULATION FOR REDUCED DEPOSIT FORMATION ON ENGINE SYSTEM COMPONENTS

The present application is a continuation of U.S. patent application Ser. No. 09/208,652 filed on Dec. 10, 1998, which claims priority to the provisional U.S. patent application Ser. No. 60/069,385 filed on Dec. 12, 1997, the disclosures of which are incorporated herein by reference.

FIELD OF THE INVENTION

This invention relates to aqueous fuel compositions. Aqueous fuel compositions are desirable for use in internal combustion engines because when combusted they produce reduced nitrogen oxide (NOx) emissions.

BACKGROUND OF THE INVENTION

One problem with using diesel-fueled engines is to the relatively high flame temperatures reached during combustion. Such high temperatures increase the tendency for the production of nitrogen oxides (NOx). These are formed from both the combination of nitrogen and oxygen in the combustion chamber and from the oxidation of organic nitrogen species in the fuel. Nitrogen oxides comprise a major irritant in smog and are believed to contribute to tropospheric ozone that is a threat to health. Environmental considerations and government regulations have increased the need to reduce NOx production. Various methods for reducing NOx production include use of catalytic converters, engine timing changes, exhaust gas recirculation, and burning of "clean" fuels. These methods are generally too expensive and/or too complicated to be placed in widespread use.

The rates at which Nox are formed is related to the flame temperature. It has been shown that a small reduction in flame temperature can result in a large reduction in the production of nitrogen oxides. One approach to lowering the flame temperature is to inject water in the combustion zone, however; this requires costly and complicated changes in engine design. The latest attempt to use water to reduce flame temperature is the use of aqueous fuels, i.e., incorporating both water and fuel into an emulsion.

Several problems that may occur from long-term use of aqueous fuels include engine corrosion, engine wear, or precipitate deposition which may lead to engine problems and ultimately to inoperability. Problematic precipitate depositions include coalescing ionic species resulting in filter plugging and inorganic post combustion deposits resulting in turbo fouling. Another problem related to aqueous fuel compositions is that they often require substantial engine modifications, such as the addition of in-line homogenizers, thereby limiting any commercial utility. Additionally, many additives used in these fuels, such as silicon produce unwanted engine system deposits.

In addition, such aqueous fuel compositions typically include a lubricity additive designed to reduce the likelihood of scuffing or seizing fuel system components, and in particular the fuel injector plunger. These lubricity additives can be very costly, therefore, any reduction, or total elimination, of the lubricity additive used would reduce the costs of desirable aqueous fuels.

SUMMARY OF THE INVENTION

In general, the invention features a substantially ashless fuel composition that includes: (a) hydrocarbon petroleum distillate; (b) purified water; and (c) an additive composition comprising an emulsifier, wherein said additive composition is free from silicon.

The fuel composition preferably is in the form of an aqueous emulsion that is stable at temperatures and pressures encountered during recirculation in a compression ignited engine. The fuel preferably has a pH of at least 9 prior to combustion in the engine thereby inhibiting engine corrosion.

In preferred embodiments, the fuel composition includes a hydrocarbon petroleum distillate, purified water, and an additive composition that includes an emulsifier. The hydrocarbon petroleum distillate is preferably diesel fuel although a naphtha distillate having a boiling point between about 220° F. and about 450° F. may be used.

The amount of the hydrocarbon petroleum distillate preferably is between about 60 weight percent and about 70 weight percent of the fuel composition, more preferably between about 63 weight percent and about 68 weight percent of the fuel composition.

The purified water preferably contains no greater than about 50 parts per million calcium and magnesium ions, and no greater than about 20 parts per million silicon. More preferably, the purified water contains no greater than about 2 parts per million calcium and magnesium ions, and preferably no silicon but no greater than about 1 part per million silicon. The amount of purified water preferably is between about 28 weight percent and about 40 weight percent of the fuel composition, more preferably between about 30 weight percent and about 35 weight percent of the fuel composition.

In a particularly preferred composition, the amount of the petroleum distillate ranges from about 43 weight percent to about 70 weight percent, the amount of the purified water ranges from about 28 weight percent to about 40 weight percent, and the amount of the additive composition is no greater than about 10 weight percent.

Many compounds which would otherwise be useful as components of the additive composition contain trace amounts of silicon and are not desirable. These silicon additives produce exhaust system deposits that are an indication of high particulate emissions that can result in premature failure of combustion chamber and exhaust system components.

The emulsifier preferably is selected from the group consisting of nonionic, anionic, and amphoteric emulsifiers, and combinations thereof. An example of a preferred alkyl amphoteric emulsifier is one having at least 12 carbon atoms. The amount of the alkyl amphoteric emulsifier preferably is between about 0.01 weight percent and about 0.1 weight percent of the fuel composition.

In additional preferred embodiments, the additive composition includes an alllylphenolethoxylate (e.g., a polyethoxylated nonylphenol having between about 8 and 12 moles of ethylene oxide per mole of nonylphenol, more preferably about 9 moles of ethylene oxide per mole of nonylphenol), an alcohol ethoxylate, a fatty alcohol ethoxylate, an alkyl amine ethoxylate, or a combination thereof. In the case of alkylphenolethoxylates, the ingredient preferably is present in an amount ranging from about 0.04 weight percent to about 1.0 weight percent of the fuel composition.

The additive composition preferably includes an organophosphoric or carboxylic mono-, di-, or tri-functional acid having at least 12 carbon atoms. An example of a preferred acid is selected from the group consisting of di- and tri-acids of the Diels-Alder adducts of unsaturated fatty acids (preferably having between about 12 and about 22 carbon atoms) and mixtures thereof. For example, the acid may be a $C_{21}$ dicarboxylic acid derived from the Diels-Alder adduct of maleic anhydride and oleic acid. The amount of the mono-, di-, or tri-acid preferably is between about 0.04 weight percent and about 0.1 weight percent of the fuel composition, more preferably between about 0.04 weight percent and about 0.05 weight percent of the fuel composition.

The additive composition preferably includes an alkanolamine. Examples of preferred alkanolamines include those selected from the group consisting of amino methyl propanol, triethanolamine,. diethanolamine, and combinations thereof, with amino methyl propanol being preferred. The amount of the alkanolamine preferably is between about 0.05 weight percent and about 0.4 weight percent of the fuel composition, more preferably about 0.06 weight percent of the fuel composition.

The additive composition preferably includes an aminoalkanoic acid. An example of a preferred aminoalkanoic acid is available from the Keil Chemical Division of Ferro Corporation under the trade designation "Synkad 8281". The amount of the aminoalkanoic acid preferably is between about 0.03 weight percent and 0.15 weight percent, more preferably 0.03 about 0.05 weight percent.

In some preferred embodiments, the additive composition includes antifreeze. The amount of antifreeze preferably is between about 2 weight percent and about 9 weight percent of the fuel composition. Examples of preferred antifreezes include $C_1$ to $C_3$ alcohols, e.g., methanol, ethanol and isopropanol.

In some preferred embodiments, the additive composition includes an ignition delay modifier. Preferred ignition delay modifiers include those selected from the group consisting of nitrates, nitrites, peroxides, and combinations thereof. An example of a preferred ignition delay modifier is 2-ethyihexylnitrate. The amount of the ignition delay modifier preferably is between about 0.1 weight percent and about 0.4 weight percent of the fuel composition.

The components of the fuel composition, and the relative amounts thereof, are preferably selected such that the fuel composition is suitable for use in diesel engines. This includes varying the formula of the fuel to maintain the lower heating value of the fuel within a range for which the engine fuel system is designed. Additionally, the fuel composition is preferably ashless, is preferably is stable at temperatures and pressures encountered during recirculation in a compression ignited engine and has a pH of at least 9 prior to combustion to inhibit engine corrosion.

Preferably the amount of the petroleum distillate ranges from about 60 weight % to about 70 weight %, the amount of the purified water ranges from about 28 weight % to about 40 weight %, and the amount of the additive composition is no greater than about 10 weight % of the fuel composition.

The fuel composition preferably has a pH of at least about 9 prior to combustion ion the engine to inhibit engine corrosion, Moreover, the fuel composition preferably is stable at temperatures and pressures encountered during recirculation in a compression ignited engine.

In a second aspect of the invention, the invention features a fuel composition that includes: (a) a hydrocarbon petroleum distillate; (b) purified water; (c) methanol; (d) polyethoxylated nonylphenol, having about 9 moles of ethylene oxide per mole of nonylphenol; (e) $C_{21}$ dicarboxylic acid derived from the Diels-Alder adduct of maleic anhydride and oleic acid; (f) amino methyl propanol; (g) an aminoalkanoic acid; and (h) 2-ethylhexyl nitrate.

The invention provides improved fuel compositions that are stable for extended periods of time under conditions typically encountered during storage. In addition, the fuels burn cleanly and efficiently.

In yet another embodiment of the invention, the amount of any lubricity additive can be reduced or eliminated by providing a protective coating to selected fuel system components, including the fuel injector plunger. The preferred fuel injector plunger coating is a metal nitride.

Other features and advantages of the invention will be apparent from the following description of the preferred embodiments thereof, and from the claims.

DESCRIPTION OF THE PREFERRED EMBODIMENTS

Preferred fuel compositions include fuel and water in the form of an emulsion in which water is the continuous phase. The fuel composition is preferably ashless and preferably silicon-free. "Ashless" means that, once the fuel components are combined, the level of particulates and coalescing ionic species is sufficiently low to allow long-term operation of the internal combustion engine (for example, substantially continuous operation for three months) without significant particulate and coalescing ionic species deposition on engine parts, including valve seats and stems, injectors and plug filters, and post-combustion engine parts such as the exhaust trains and turbo recovery units. The level of ash is determined by monitoring water purity, exhaust emissions, and by engine autopsy. Engine autopsy, including dismantling and metallurgical analysis, is also used to analyze corrosion and wear.

Examples of suitable fuels include hydrocarbon petroleum distillates such as naphtha, kerosene, diesel, and aliphatics and paraffinics, used alone or in combination with each other. Preferably, the hydrocarbon distillates are highly paraffinic, meaning they have a low aromatic content (e.g., below about 10 percent, and more preferably below about 3 percent). The preferred carbon chain lengths are in the range of $C_8$ to $C_{16}$.

Preferred compositions include about 60% to about 70% by weight fuel, more preferably about 63% to about 68% fuel. The amount of fuel is selected so that the kilowatt per gallon provided by combusting the fuel composition is sufficiently high so that the engine need not be de-rated.

The water functions as an extender and carrier of the fuel. Using water as the continuous phase makes the composition safer to use relative to non-aqueous fuels. The water also results in reduced NOx and particulate emissions. The water is preferably purified such that it contains very low concentrations of calcium ions, magnesium ions, silicon, and other impurities. This is desirable because impure water contributes to ashing and engine deposit problems after long-term use, which can lead to wear, corrosion, and engine failure. Suitable purification techniques are well-known and include distillation, ion exchange treatment, and reverse osmosis, with reverse osmosis being preferred due to lower cost and ease of operation. The water is preferably purified such that it contains no greater than about 50 parts per million calcium or magnesium ions (more preferably no greater than about 2 parts per million), and no greater than about 20 parts per million of silicon (more preferably no greater than about 1 part per million). Preferred compositions include about 28% to about 40% by weight water, more preferably about 30% to 35% water.

The composition preferably includes additives. The additives are preferably selected so that the fuel composition is ashless. The amount of additive selected is preferably sufficiently high to perform its intended function. The amounts are preferably sufficiently low to control the fuel composition cost. The composition preferably includes an emulsifier, which facilitates the formation of a stable emulsion of the hydrocarbon fuel within the continuous water phase. A stable emulsion is desirable because a separate water phase will lead to combustion problems. Stability means no substantial phase separation in long term storage under typical storage conditions, for example up to about three months. A small amount of phase separation in the storage tank containing the fuel composition may be tolerated because pumping the fuel composition will ensure sufficient emulsification. Preferred emulsifiers are ashless and do not chemically react with other components in the fuel composition. Examples of suitable emulsifiers include nonionic, anionic and amphoteric emulsifiers. Combinations of different types of emulsifiers may be used as well.

Examples of suitable nonionic emulsifiers include alkylphenolethoxylatesi alcohol ethoxylates, fatty alcohol ethoxylates, and alkyl amine ethoxylates. Of these, the alkylphenolethoxylates and alcohol ethoxylates are preferred. Of the alkylphenolethoxylates, polyethoxylated nonylphenols having between 8 and 12 (preferably about 9) moles of ethylene oxide per mole of nonylphenol are preferred. Such nonylphenols are commercially available, e.g., from Rhone-Poulenc under the trade designation "Igepal CO-630(™). Preferred compositions include about 0.3% to about 1.0%, preferably 0.4–0.6, by weight nonionic emulsifier, more preferably about 0.47%.

A suitable anionic emulsifier is a $C_{21}$ dicarboxylic acid derived from the Diels-Alder adduct of acrylic acid and oleic acid (commercially available from Westvaco under the trade designation "Diacid 1550 (™)"), which is neutralized with an alkanolamine to form a water soluble salt. Another suitable anionic emulsifier is a $C_{22}$ tricarboxylic acid derived from the Diels-Alder adduct of maleic anhydride and oleic acid (commercially available from Westvaco under the trade designation Tenax 2010 (™). Suitable alkanolamine neutralizers include amino methyl propanol, triethanolamine, and diethanolamine, with amino methyl propanol (available from Angus Chemical under the trade designation AMP-95 (™) being preferred. Preferred compositions include about 0.04% to 0.1% by weight dicarboxylic acid (more preferably 0.04% to 0.05%), and about 0.05 to 0.4% by weight neutralizer (more preferably about 0.06%).

Preferred amphoteric emulsifiers are alkyl amphoteric emulsifiers containing C16 and higher alkyl groups. The amount of amphoteric emulsifier generally ranges from 0.01 to 0.1% by weight, and preferably is about 0.015%.

The fuel composition preferably includes a lubricant to improve the slip of the water phase and for continued smooth operation of the fuel delivery system. The amount of lubricant generally ranges from about 0.04% to 0.1% by weight, more preferably from 0.04% to 0.05% by weight. Suitable lubricants include a combination of mono-, di-, and tri-acids of the phosphoric or carboxylic types (preferably neutralized, e.g., with an alkanolamine), adducted to an organic backbone. The carboxylic types are more preferred because of their ashless character. Examples include mixed esters of alkoxylated emulsifiers in the phosphate form, and di- and tri-acids of the Diels-Alder adducts of unsaturated fatty acids. The organic backbone preferably contains about 12 to 22 carbons. A specific example of a suitable lubricant is Diacid 1550(™), which is preferred due to its high functionality at low concentrations. Another example of a suitable lubricant is Tenax 2010(™).

As indicated above, a further aspect of the invention is the surface treatment or coating of selected fuel system components to augment the lubricity of the fuel. The surface treatment or coating can be used in addition to, or preferably in lieu of the use of lubricant additives. For example, a coating on the fuel injector plunger can significantly reduce the possibility of scuffs and seizures of the plunger, thus improving the operating reliability of the engine running on a water continuous fuel emulsion. This coating can reduce or eliminate the need for adding lubricants to the aqueous fuel compositions disclosed herein. A preferred fuel system component coating consists of a metal nitride, preferably a chromium nitride or titanium nitride. The coating is applied to the fuel system components, including the fuel injector plunger, by methods generally known in the art.

In either of the aforementioned embodiments, the fuel composition preferably includes a pH—maintaining additive capable of maintaining the pH of the fuel composition at a pH of at least about 9 throughout the combustion cycle of an internal combustion engine. Above a pH of about 9, the water in the fuel composition does not significantly attack the iron components of the engine. Examples of suitable additives include alkanolamines such as amino methyl propanol, triethanolamine, and diethanolamine, with amino methyl propanol being preferred. The amount of the pH maintaining additive generally ranges from about 0.05% to 0.4% by weight, and preferably is about 0.06% by weight.

The fuel composition may also include a coupling agent (hydrotrope) to maintain phase stability at high temperatures and shear pressures. High temperature and shear pressure stability is required, for example, in compression ignited (diesel) engines because all the fuel delivered to the manifold may not be burned to obtain the required power load in a given cycle. Thus, some fuel may be recirculated back to the fuel tank The relatively high temperature of the recirculated fuel, coupled with the shear pressures encountered during recirculation, tends to cause phase separation in the absence of the coupling agent. Examples of preferred coupling agents include di-and tri-acids of the Diels-Alder adducts of unsaturated fatty acids. A specific example of a suitable coupling agent is Diacid 1550(™), neutralized with an alkanolamine to form a water soluble salt. Suitable alkanolamine neutralizers include amino methyl propanol triethanolamine, and diethanolamine, with amino methyl propanol preferred. The amount of the coupling agent typically ranges from about 0.04% to 0.1% by weight, more preferably 0.04 to 0.05%.

The fuel composition may also include a corrosion inhibitor, preferably one that does not contribute a significant level of inorganic ash to the composition. Aminoalkanoic acids are preferred. An example of a suitable corrosion inhibitor is available from the Keil Chemical Division of Ferro Corporation under the trade designation "Synkad 828(™)". Preferred compositions include about 0.05% by weight corrosion inhibitor.

The fuel composition may also include an ignition delay modifier (cetane improver) to improve fuel detonation characteristics, particularly where the fuel composition is used in compression ignited (diesel) engines. Examples include nitrates, nitrites, and peroxides. The preferred ignition delay modifier is 2-ethylhexylnitrate, available from Ethyl Corporation under the trade designation "HiTec 4103". Preferred compositions include about 0.1% to 0.4% by weight ignition delay modifier.

An antifreeze may also be included in the fuel composition. Organic alcohols are preferred. Specific examples include methanol, ethanol, isopropanol, and glycols, with methanol being preferred. The amount of antifreeze preferably ranges from about 2% to about 9% by weight.

Biocides known to those skilled in the art may also be added, provided they are ashless. Antifoam agents known to those skilled in the art may be added as well, provided they are ashless and free of silicon. The amount of antifoam agent preferably is not more than 0.0005% by weight.

The invention includes additives which perform multiple functions. For example, Diacid 1550(™) acts as an emulsifier, lubricant, and coupling agent. Similarly, AMP-95(™) acts as a neutralizer and helps maintain the pH of the fuel composition at a value of at least about 9.

A preferred fuel composition has the following composition: 64.8% by weight petroleum distillate, 32.2% by weight water, 2% by weight methanol, 0.47% by weight Igepal CO-630(™), 0.04% Diacid 1550(™), 0.06% AMP-95(™), 0.06% Synkad 828(™), and 0.37% 2-ethylhexylnitrate.

The fuel compositions may be manufactured using a batch or continuous process. In the batch process, the oil phase ingredients (e.g., the hydrocarbon fuel and any other oil-soluble ingredients) are charged to a stirred tank reactor along with the emulsifier. The aqueous phase ingredients (e.g., water and any other water-soluble additives) are combined separately and then pumped into the reactor, where they are combined with agitation with the oil phase ingredients to form an emulsion. When the concentration of water has reached a sufficiently high level, phase inversion occurs, resulting in water being the continuous phase.

The resulting coarse emulsion is transferred from the reactor into a storage tank using a shear pump which provides the final fine droplet dispersion. The emulsion is aged in the storage tank. The resulting product is a stable, homogeneous, milky emulsion having an average droplet diameter ranging from about 5 to 15 microns.

In the continuous process, the ingredients (with the exception of the fuel and the water) are combined in the form of a stream, and then fed to a first in-line blending station where they are combined with a fuel stream. The resulting product is then combined with water in a second in-line blending station to form the fuel composition, which is then pumped using a shear pump to a storage tank where it is aged. As in the case of the batch process, the product is in the form of a stable, homogeneous, milky emulsion having an average droplet diameter ranging from about 5 to 15 microns.

The utilization of the disclosed fuel composition results in significantly less engine wear and deposit formation on engine system components than similar such aqueous fuel compositions that incorporate silicon based additives such as Miritaine and selected antifoam agents.

The following Examples will serve to further typify the nature of the invention but should not be construed as a limitation on the scope thereof.

EXAMPLE 1

An aqueous fuel emulsion (Fuel Composition 1) may be prepared by mixing the following:

| Component | % Weight | ppm by weight |
|---|---|---|
| Petroleum Distillate | 64.8 | |
| Purified Water | 32.2 | |
| Methanol | 2 | |
| Igepal CO-630 (TM) | 0.47 | |
| Diacid 1550 (TM) | 0.04 | 400 |
| AMP-95 (TM) | 0.06 | 600 |
| Synkad 828 (TM) | 0.06 | 500 |
| 2-ethyihexyl nitrate | 0.37 | 3,700 |

The fuel is prepared by first mixing the Diacid 1550(™) with the methanol. The AMP-95W(™) is then added. The Synkad 828 is then added. The mixture is agitated. The mixture is charged into a vessel with the purified water and agitated for about 1–5 minutes. Then the petroleum distillate and 2-ethylhexyl nitrate are charged into the vessel, and the composition is agitated for 15–30 minutes.

The aqueous fuel composition is pumped through a shear pump against a pressure valve at about 50 to about 120 psi. The fuel composition is stored at ambient temperatures.

EXAMPLE 2

A fuel composition similar to that prepared according to Fuel Composition 1 with an antifoam agent was run in a diesel engine to monitor NOx and particulate emissions. The engine used was a Caterpillar 3176B compression-ignited truck engine (four stroke, fully electronic, direct injected engine with electronic unit injectors, a turbocharger, and a four valve quiescent head). The Caterpillar 3176B truck engine was rated at 350 hp at 1800 rpm with a peak torque of 1350 ft-lbs at 1200 rpm and modified to run a fuel-in-water emulsion. A simulated air-to-air aftercooler (43° C. inlet manifold temp.) was used.

The electronic unit injectors were changed to increase the quantity of fuel injected into the cylinder. As modified, the electronic unit injector Caterpillar Part Number 116-8800 replaced the standard injector Caterpillar Part Number 116-8888. In addition, the electronic control strategy was optimized with respect to emissions, fuel consumption, and cold starting. The emissions of Fuel Composition 1 were compared to diesel fuel emissions, using the US EPA Heavy Duty Transient test cycle. The results are presented on the following table:

| | Diesel typical | Fuel Composition 1 |
|---|---|---|
| NOx | 4.24 g/hp-hr | 2.45 g/hp-hr |
| Particulates | 0.082 g/hp-hr | 0.05 g/hp-hr |
| $H_xC_x$ | 0.18 g/hp-hr | 0.42 g/hp-hr |
| CO | 1.39 g/hp-hr | 2.10 g/hp-hr |

EXAMPLE 3

The thermal efficiency of Fuel Composition 1 with an antifoam agent was compared to diesel fuel, measured at three different steady state operating conditions. The engine used is Caterpillar 3176B modified as described in Example 2, with the fuel injection timing adjusted to give the best thermal efficiency within the specified cylinder pressure limit of 15.2 MPa. The thermal efficiency of Fuel Composition 1 was comparable to diesel fuel, notwithstanding the water content.

| | Fuel Comp. 1 | Diesel | Fuel Comp. 1 | Diesel | Fuel Comp. 1 | Diesel |
|---|---|---|---|---|---|---|
| Engine Speed (rpm) | 1500 | 1500 | 1800 | 1900 | 1200 | 1200 |
| Engine Power (hp) | 201 | 201 | 316 | 325 | 278 | 285 |
| Fuel Rate (gal/min) | 727 | 485 | 1220 | 790 | 1035 | 693 |
| Thermal Efficiency | 43.0 | 43.4 | 40.2 | 43.1 | 41.7 | 43.1 |

From the foregoing, it should be appreciated that the present invention thus provides an improved aqueous fuel emulsion comprising a hydrocarbon petroleum distillate, purified water, and an additive composition, in which the aqueous fuel composition, and particularly the additive composition, is comprised of components which are essentially free of silicon, resulting in a fuel having reduced particulate emissions with a resulting reduction in exhaust system deposits. While the invention herein disclosed has been described by means of specific embodiments and processes associated therewith, numerous modifications and variations can be made thereto by those skilled in the art without departing from the scope of the invention as set forth in the claims or sacrificing all its material advantages.

What is claimed is:

1. An aqueous fuel composition comprising:

diesel fuel;

purified water;

methanol;

amino methyl propanol;

2-ethylhexyl nitrate; and a surfactant system including polyethoxylated nonylphenol having about 9 moles of ethylene oxide per mole of nonylphenol comprising between about 0.4% and about 1.0 % by weight, an aminoalkanoic acid comprising between about 0.03% and about 0. 15% by weight, and $C_{21}$ dicarboxylic acid derived from the Diels-Alder adduct of maleic anhydride and oleic acid comprising between about 0.04% and about 0.1% by weight.

* * * * *